US008063866B2

(12) United States Patent
Hayashi et al.

(10) Patent No.: US 8,063,866 B2
(45) Date of Patent: Nov. 22, 2011

(54) DISPLAY DEVICE CAPABLE OF MEASURING AN ILLUMINANCE AND WIDENING A DYNAMIC RANGE OF THE MEASURED ILLUMINANCE

(75) Inventors: Hirotaka Hayashi, Fukaya (JP); Takashi Nakamura, Saitama (JP); Masayoshi Fuchi, Ageo (JP); Masahiro Tada, Tokyo (JP); Hiroki Nakamura, Ageo (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 565 days.

(21) Appl. No.: 12/257,778

(22) Filed: Oct. 24, 2008

(65) Prior Publication Data

US 2009/0128477 A1 May 21, 2009

(30) Foreign Application Priority Data

Nov. 15, 2007 (JP) ..... 2007-296912
May 20, 2008 (JP) ..... 2008-131822

(51) Int. Cl.
*G09G 3/36* (2006.01)

(52) U.S. Cl. ..... 345/98; 345/102; 313/504

(58) Field of Classification Search ..... 345/87–100, 345/207, 102; 250/205, 214 R; 313/504, 313/506

See application file for complete search history.

(56) References Cited

U.S. PATENT DOCUMENTS

| | | | | |
|---|---|---|---|---|
| 4,571,690 | A * | 2/1986 | Munetsugu | 700/298 |
| 4,972,501 | A * | 11/1990 | Horyu | 382/114 |
| 5,434,595 | A * | 7/1995 | Macaulay | 345/207 |
| 5,652,655 | A * | 7/1997 | Uno et al. | 356/600 |
| 6,120,461 | A * | 9/2000 | Smyth | 600/558 |
| 6,995,753 | B2 * | 2/2006 | Yamazaki et al. | 345/204 |
| 2007/0070056 | A1 * | 3/2007 | Sato et al. | 345/207 |
| 2008/0001070 | A1 | 1/2008 | Nakamura et al. | |

FOREIGN PATENT DOCUMENTS

| | | |
|---|---|---|
| JP | 4-174819 | 6/1992 |
| JP | 9-146073 | 6/1997 |
| JP | 2007-114315 | 5/2007 |

OTHER PUBLICATIONS

Notification of Reasons for Refusal issued by the Korean Patent Office on May 19, 2010, for Korean Patent Application No. 10-2008-113458, and English-language translation thereof.

* cited by examiner

*Primary Examiner* — Kimnhung Nguyen
(74) *Attorney, Agent, or Firm* — Finnegan, Henderson, Farabow, Garrett & Dunner, L.L.P.

(57) ABSTRACT

A capacitor charged beforehand is discharged according to a light surrounding a display unit. A data is decreased similarly to the voltage between the electrodes of the capacitor. A trigger signal is outputted if the data becomes equal to or less than a threshold value. A clock signal whose cycle of changing levels gradually becomes long is generated. A count value is updated at each change of the clock signal's level and the updated count value is outputted. The count value is sampled when the trigger signal is outputted.

3 Claims, 7 Drawing Sheets

FIG. 9

| OUTPUT VALUE | COUNT VALUE |
|---|---|
| 0 | 32001~65535 |
| 1 | 16000~31999 |
| 2 | 8000~15999 |
| 3 | 4000~7999 |
| 4 | 3000~3999 |
| ⋮ | ⋮ |
| 13 | 11~400 |
| 14 | 3~10 |
| 15 | 0~2 |

DISPLAY DEVICE CAPABLE OF MEASURING AN ILLUMINANCE AND WIDENING A DYNAMIC RANGE OF THE MEASURED ILLUMINANCE

CROSS-REFERENCE TO RELATED APPLICATIONS

This application is based upon and claims the benefit of priority from Japanese Patent Application No. 2007-296912 filed on Nov. 15, 2007 and Japanese Patent Application No. 2008-131822 filed on May 20, 2008; the entire contents of which are incorporated herein by reference.

BACKGROUND OF THE INVENTION

1. Field of the Invention

The present invention relates to a display device capable of measuring illuminance and widening a dynamic range of the measured illuminance.

2. Description of the Related Art

It is demanded to reduce an electric power consumption of an equipment having a display device. As for a liquid crystal display device, a method to reduce an electric power consumption is under study. The method is to decrease brightness of a backlight when a surrounding illuminance of a display unit is low, for example, at night. It is thought that an electric power consumption of an organic electro-luminescence display device can be reduced as well by decreasing brightness of light-emitting pixels when a surrounding illuminance is low, for example, at night. Specifically, there is a proposal to arrange a light sensor circuit in an area surrounding a display unit of such display device and use an output of the light sensor circuit to decrease a brightness of a backlight or pixels.

Liquid crystal display devices each having a light sensor circuit separated from a display panel are disclosed in Japanese Unexamined Patent Application Laid-open Nos. 1992-174819/1997-146073. However such separation makes it difficult to form devices smaller or thinner. To solve this, a technique of making a liquid crystal display device smaller or thinner by forming a light sensor circuit in a display panel is disclosed in Japanese Unexamined Patent Application Laid-open No. 2007-114315. Additionally, in the liquid crystal display device, a brightness of a backlight is controlled so as to measure an illuminance precisely.

By the way, in measuring an illuminance by the device such as the display device mentioned above, the following operation is done.

A preset count value is updated at each change of a clock signal's level. A trigger signal is outputted at time corresponding to the illuminance. The count value is sampled when the trigger signal is outputted. The sampled count value corresponds to the illuminance.

If a cycle of the change of the clock signal's level is short, a length of a period when the maximum count value becomes the minimum is short. Therefore, the count value can represent only a narrow range of an illuminance such as one from about 80 [lx] to about 1000 [lx] for example. That is, a dynamic range of an illuminance the count value can represent is as narrow as about 10 times.

Therefore, the display device can only be used in a room where an illuminance is low for example. Oppositely, the device can only be used outdoors where an illuminance is high for example. As a result, the convenience of the display device is ruined.

The present invention has been made in view of the foregoing points. An object of the present invention is to provide a display device capable of measuring an illuminance and widening a dynamic range of the measured illuminance.

SUMMARY OF THE INVENTION

A display device according to the first present invention is characterized by including: a display unit having pixels; a light sensor circuit having a capacitor and a light-into-electricity conversion element that discharges the capacitor according to a surrounding illuminance of the display unit; an arithmetic circuit that decreases a data similarly to the voltage between the electrodes of the capacitor and outputs a trigger signal if the data becomes equal to or less than a threshold value; a clock signal generating circuit that generates a clock signal whose cycle of changing levels gradually becomes long; a counter circuit that updates a count value at each change of the clock signal's level; and a sampling latch circuit that samples the count value when the trigger signal is outputted.

In the first present invention, since the clock signal's cycle of changing levels gradually becomes long, a dynamic range of the sampled count value becomes wide. That is, a wide dynamic range of an illuminance can be measured.

A display device according to the second present invention is characterized by including: a display unit having pixels; a light sensor circuit having a capacitor and a light-into-electricity conversion element that discharges the capacitor according to a surrounding illuminance of the display unit; an arithmetic circuit that decreases a data similarly to the voltage between the electrodes of the capacitor and outputs a trigger signal if the data becomes equal to or less than a threshold value; a clock signal generating circuit that generates a clock signal whose level changes periodically; a counter circuit that updates a count value at each change of the clock signal's level; a sampling latch circuit that samples the count value when the trigger signal is outputted; and a value conversion circuit having a map table which has ranges for the sampled count value each associated with an output value, the value conversion circuit being configured to find one of the ranges which includes the sampled count value and outputs the output value associated with the range found; wherein the larger the output value of the map table is, the narrower the associated range is.

In the second present invention, since the larger the output value of the map table is, the narrower the associated range is, a dynamic range of the outputted output value becomes wide. That is, a wide dynamic range of an illuminance can be measured.

BRIEF DESCRIPTION OF THE DRAWINGS

FIG. 9 illustrates an example content of a map table used in the liquid crystal display device in FIG. 7;

DESCRIPTION OF THE EMBODIMENT

First Embodiment

Figure 1:
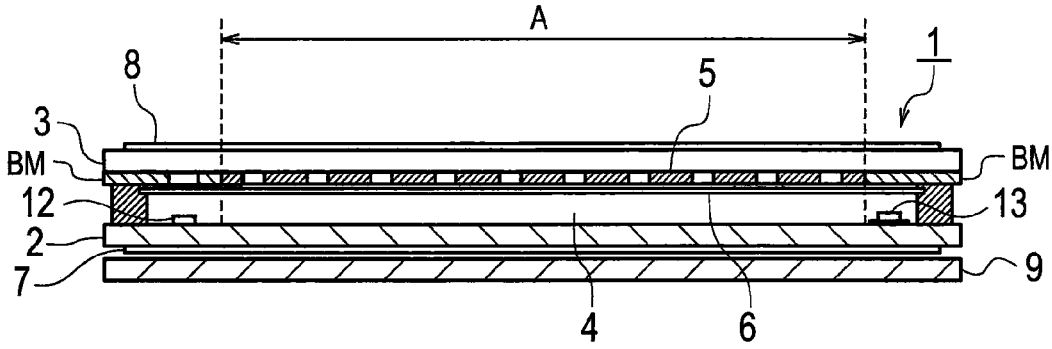
FIG. 1 illustrates a cross section view of a liquid crystal display device according to a first embodiment of the present invention.

In the liquid crystal display device according to the first embodiment, a pair of insulative and light transmittable substrates composes a liquid crystal cell. A liquid crystal material sealed between the substrates forms a liquid crystal layer. Specifically, as illustrated in FIG. 1, in the liquid crystal display device 1, a liquid crystal layer 4 is formed between an array substrate 2 and an opposite substrate 3.

The array substrate 2 has an insulative and light-transmittable substrate that consists of a glass, and the like, as a supportive substrate. On the supportive substrate, scanning lines are formed almost in parallel and at equal intervals. Signal lines are formed in almost orthogonal to the scanning lines. A transparent in-layer insulative film is formed between the scanning lines and the signal lines to insulate the scanning lines and the signal lines electrically to each other. A thin film transistor as a switching element and the likes are formed near each cross point of the scanning line and the signal line.

In the array substrate 2, pixel electrodes are formed like a matrix. The each pixel electrode is connected electrically to the corresponding switching element through a through hole formed in the in-layer insulative film. Note that, as mentioned, though the scanning lines, the signal lines, the switching elements such as the thin film transistors and the in-layer insulative film and the like are arranged between the supportive substrate of the array substrate and the pixel electrodes, they are omitted in the FIG. 1. Moreover, though an orientation film is formed on the whole pixel electrodes, the orientation film is also omitted.

The opposite substrate 3 has an insulative and light transmittable substrate that consists of a glass, and the like, as a supportive substrate too. On a side of the opposite substrate 3 facing to the liquid crystal layer 4, color filter layers 5 are formed each corresponding to the pixel. A transparent opposite electrode 6 that consists of a transparent and conductive material such as Indium Tin Oxide, and the like is formed on the whole color filter layers 5. The each color filter layer is a resin layer colored by dye or pigments. The each pixel includes, for example, the red filter layer, the green filter layer and the blue filter layer. Though omitted in the figure, in order to improve a contrast ratio and the likes, a black matrix layer is formed to fill areas each surrounding the whole color filter layers of the corresponding pixel.

Polarizing plate 7, 8 are arranged on a backside of the array substrate 2 and on a front side of the opposite substrate 3 respectively. Image displaying is performed using a backlight 9 as a light source arranged backside.

Figure 2:
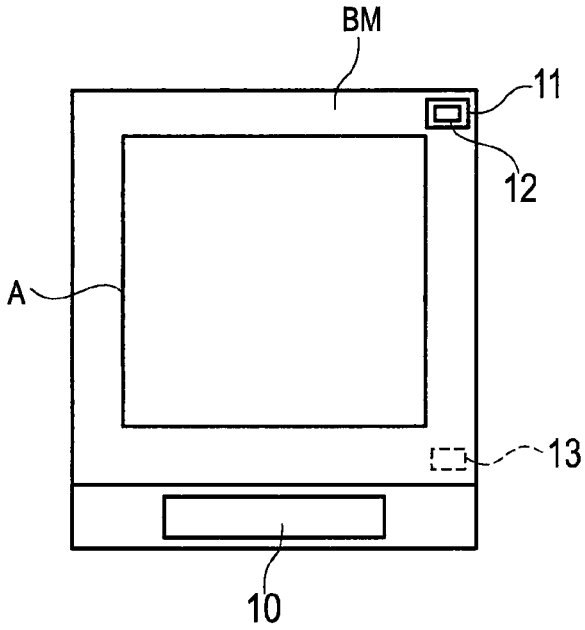
FIG. 2 illustrates a plan view of the liquid crystal display device in FIG. 1.

As illustrated in FIG. 2, a black matrix BM is formed in an area shaped like a picture frame surrounding a display unit A consisted by the pixels so that a light from the backlight is prevented from being leaked. An outside Large Scale Integration device 10 is mounted on the array substrate 2 outside the area the black matrix BM is formed by Chip on Glass method.

A basic composition of the liquid crystal display device 1 is as described above.

Additionally, in the liquid crystal display device 1, an opening 11 is formed in the black matrix BM and a light sensor circuit 12 for measuring a surrounding illuminance is mounted on the array substrate facing the opening 11. Alight sensor circuit 13 for measuring a background current is mounted on the array substrate shaded under the black matrix BM.

Figure 3:
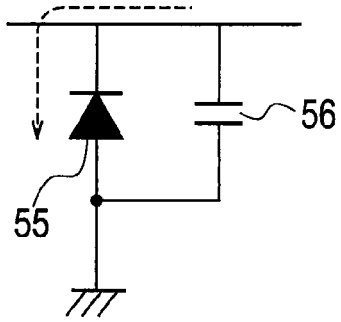
FIG. 3 illustrates a circuit diagram of a light sensor circuit included in the liquid crystal display device in FIG. 1.

FIG. 3 illustrates a circuit diagram of the each light sensor circuit 12 and 13. The light sensor circuits 12 and 13 are mutually equal and the each light sensor circuit has a photodiode 55 and a capacitor 56. The photodiode 55 of the light sensor circuit 12 is a light-into-electricity conversion element that converts a light surrounding the display unit A into an electric signal.

In the each light sensor circuit, at a preset time, a preset voltage Vprc charges the capacitor 56 beforehand. In the light sensor circuit 12, a light current according to a surrounding illuminance of the display unit A flows in the photodiode 55. In the light sensor circuit 13, a background current flows in the photodiode 55.

Figure 4:
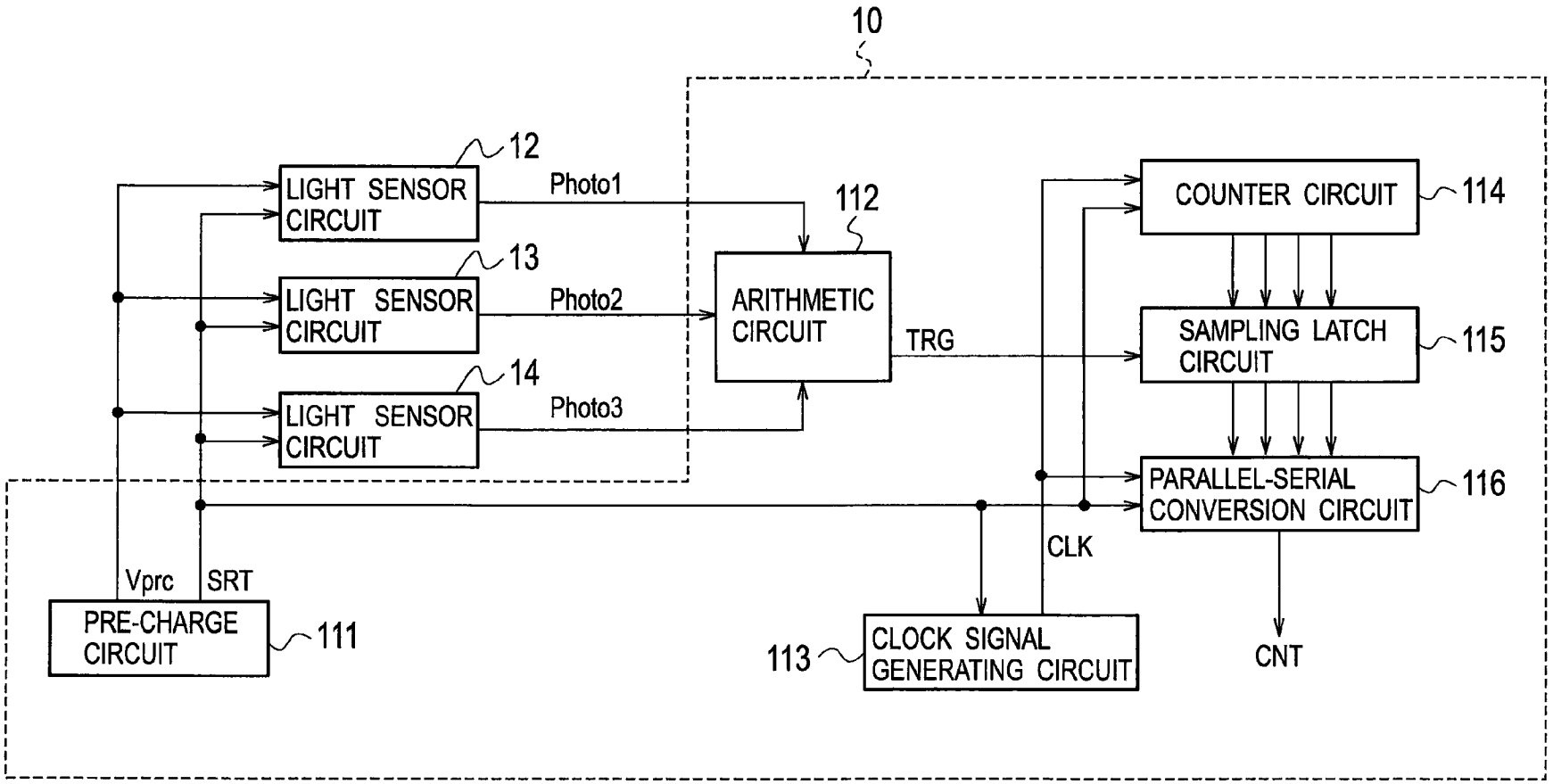
FIG. 4 illustrates a block diagram of a part of an outside Large Scale Integration device included in the liquid crystal display device in FIG. 1 and the light sensor circuits.

FIG. 4 illustrates a block diagram of a part of the outside Large Scale Integration device 10 and the light sensor circuits 12 and 13 and a light sensor circuit 14 installed in addition. For example, the light sensor circuit 14 is for measuring an illuminance of the backlight 9, and the light sensor circuit 14 only receives a light from the backlight 9.

The outside Large Scale Integration device 10 has a pre-charge circuit 111, an arithmetic circuit 112, a clock signal generating circuit 113, a counter circuit 114, a sampling latch circuit 115 and a parallel-serial conversion circuit 116.

The pre-charge circuit 111 firstly provides the constant voltage Vprc to the light sensor circuits 12, 13 and 14. At a preset time during the voltage Vprc is provided, the pre-charge circuit 111 provides a start signal SRT, one pulse signal for example, to the light sensor circuits 12, 13 and 14, the clock signal generating circuit 113, the counter circuit 114 and the parallel-serial conversion circuit 116.

The each light sensor circuit 12, 13 and 14 charges the capacitor 56 by the voltage Vprc beforehand. Specifically, for example, the light sensor circuit connects a wiring the voltage Vprc is applied and a positive electrode of the capacitor by turning on an analog switch composed by a thin film transistor, and the like not illustrated. Thus, a voltage between the electrodes of the capacitor 56 equals the voltage Vprc.

The each light sensor circuit 12, 13 and 14, for example, disconnects the wiring the voltage Vprc is applied and the capacitor 56 by turning off the analog switch mentioned above when the start signal SRT is provided. The light current having an amount according to a surrounding illuminance of the display unit A flows in the photodiode 55 of the light sensor circuit 12. The background current flows in the photodiode 55 of the light sensor circuit 13. The light current having an amount according to an illuminance of the backlight 9 flows in the photodiode 55 of the light sensor circuit 14. Therefore, the each capacitor 56 is discharged and the voltage between the electrodes decreases. The light sensor circuits 12, 13 and 14 output the voltages of the positive electrodes of the capacitors as electric signals Photo 1, Photo 2 and Photo 3 respectively.

The arithmetic circuit 112 generates a data having a preset amount and gradually decreases the data similarly to the level of the electric signal Photo 1 from the light sensor circuit 12 that is decreased by the discharge of the capacitor 56. At this time, the arithmetic circuit 112 corrects the data according to the level of the electric signal Photo 2 from the light sensor circuit 13 for measuring the background current and the level of the electric signal Photo 3 from the light sensor circuit 14 for measuring the illuminance of the backlight 9. Note that the arithmetic circuit 112 operates so that the corrected data decreases similarly to the level of the electric signal Photo 1.

The arithmetic circuit 112 memorizes a threshold value beforehand and provides the trigger signal TRG, one pulse signal for example, to the sampling latch circuit 115 when the corrected data becomes equal or less than the threshold value.

The clock signal generating circuit 113 provides a clock signal CLK to the counter circuit 114 and the parallel-serial conversion circuit 116.

Figure 5:
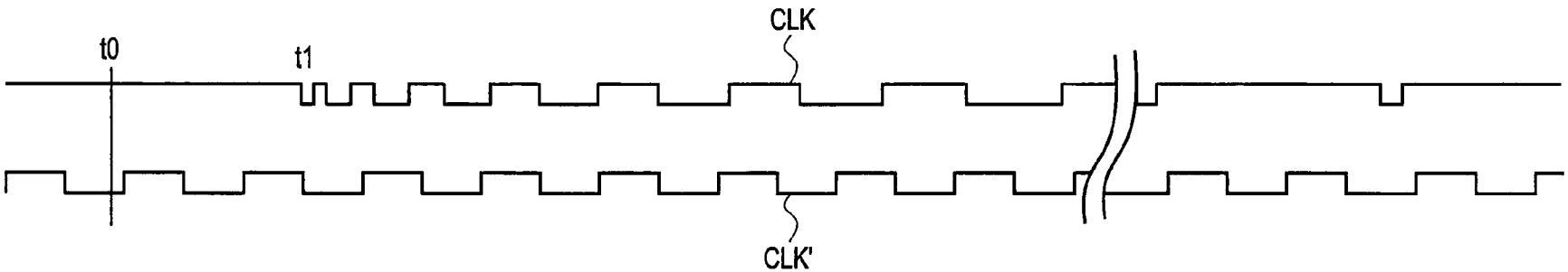
FIG. 5 illustrates waveforms of a clock signal used in the liquid crystal display device in FIG. 1 and a clock signal of a comparative example.

As illustrated in FIG. 5, the clock signal generating circuit 113 generates the clock signal CLK whose cycle of changing levels gradually becomes long, the changing levels starting, for example at a time T1 after a time T0 when the start signal SRT is provided. The clock signal generating circuit 113 provides the clock signal CLK generated thus to the counter circuit 114 and the parallel-serial conversion circuit 116.

In FIG. 4, the counter circuit 114 here decrements a count value CNT. The counter circuit 114 resets the count value CNT when the start signal SRT is provided. Here, it is assumed that the count value CNT is a 4 bits value. The count value CNT is reset to 16 that is the maximum of a range a 4 bits value can represent. Then the count value CNT is decremented by one until becoming 1 that is the minimum of the range.

The counter circuit 114 decrements the count value CNT at each change of the level of the clock signal CLK The counter circuit 114 provides the count value CNT to the sampling latch circuit 115 by parallel signals whenever the count value is decremented. The counter circuit 114 does this also when the count value CNT is reset.

The sampling latch circuit 115 samples the count value CNT when the trigger signal TRG is outputted. The sampling latch circuit 115 provides the sampled count value CNT to the parallel-serial conversion circuit 116 by parallel signals. The parallel-serial conversion circuit 116 converts the parallel signals to a serial signal and outputs the serial signal.

Figure 6:
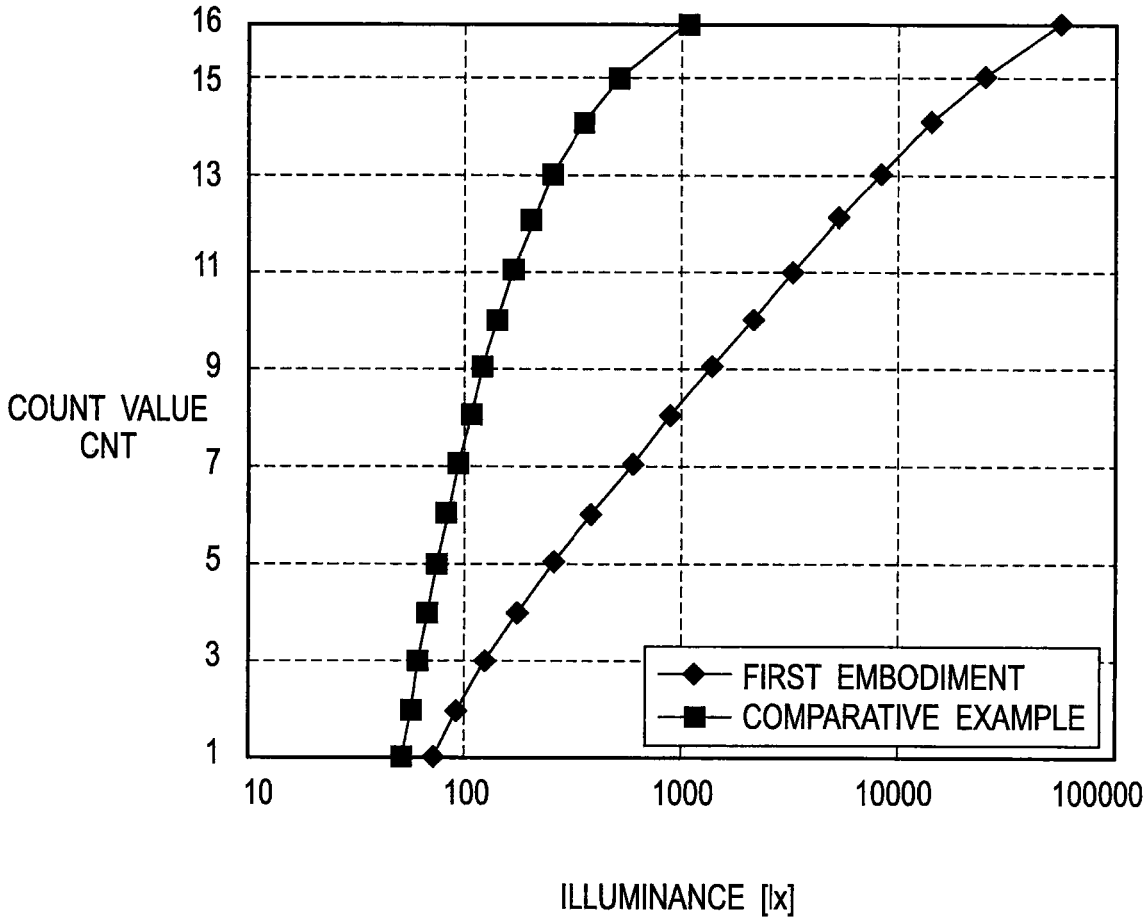
FIG. 6 illustrates a relation of an illuminance measured in the liquid crystal display device in FIG. 1 and a count value used in the device and a relation of an luminance measured in a device of a comparative example and a count value used in the device.

As illustrated in FIG. 6, the count value CNT outputted by the serial signal is a 4 bits value, the count value CNT is included in a range from 1 to 16, and corresponds to the illuminance.

For example, the lower the illuminance is, the more gradual the decrease of the level of the electric signal Photo 1 illustrated in FIG. 4 is. Therefore, the lower the illuminance is, the later the trigger signal TRG is provided. Therefore, the lower the illuminance is, the lower the outputted count value CNT is.

In the first embodiment, the count value CNT is 1 in case that the illuminance is about 90 [lx] for example. The count value CNT is 16 in case that the illuminance is about 90000 [lx] for example. That is, the count value CNT can represent a dynamic range of an illuminance that is about 1000 times.

A comparative example will be described. In the comparative example, the clock signal generating circuit 113 generates a clock signal CLK' illustrated m FIG. 5, whose cycle of changing levels is constant. The clock signal generating circuit 113 provides the clock signal CLK' to the counter circuit 114 and the parallel-serial conversion circuit 116.

Since the cycle of changing levels of the clock signal CLK' in the comparative example is constant while that of the clock signal CLK in the first embodiment gradually becomes long, the length of time when the count value CNT becomes from 16 to 1 in the comparative example might be shorter than that in the first embodiment.

Therefore, the count value CNT in the first embodiment is able to represent a dynamic range of an illuminance that is about 1000 times as described above while the count value CNT in the comparative example might be able to represent a dynamic range that is only about 10 times for example.

As illustrated in FIG. 6, in the comparative example, the count value CNT is 1 in case that the illuminance is about 70 [lx] for example. The count value CNT is 16 in case that the illuminance is about 10000 [lx] for example.

On the contrary, in the first embodiment, as described above, the count value CNT is 1 in case that the illuminance is about 90 [lx] for example. The count value CNT is 16 in case that the illuminance is about 90000 [lx] for example.

In the first embodiment, since the clock signal's cycle of changing levels becomes long, linearity between the illuminance that is represented by logarithm as in FIG. 6 and the count value can be excellent.

Therefore, according to the first embodiment, since the clock signal's cycle of changing levels gradually becomes long, a dynamic range of the sampled count value CNT becomes wide. That is, a wide dynamic range of an illuminance can be measured. As a result, an illuminance can be measured both in the dark room and in outdoor of fine weather.

Note that the arithmetic circuit 112 does not have to correct the data although the arithmetic circuit 112 does in the first embodiment. In this case, the light sensor circuit 13 and the light sensor circuit 14 are not necessary.

Second Embodiment

Figure 7:
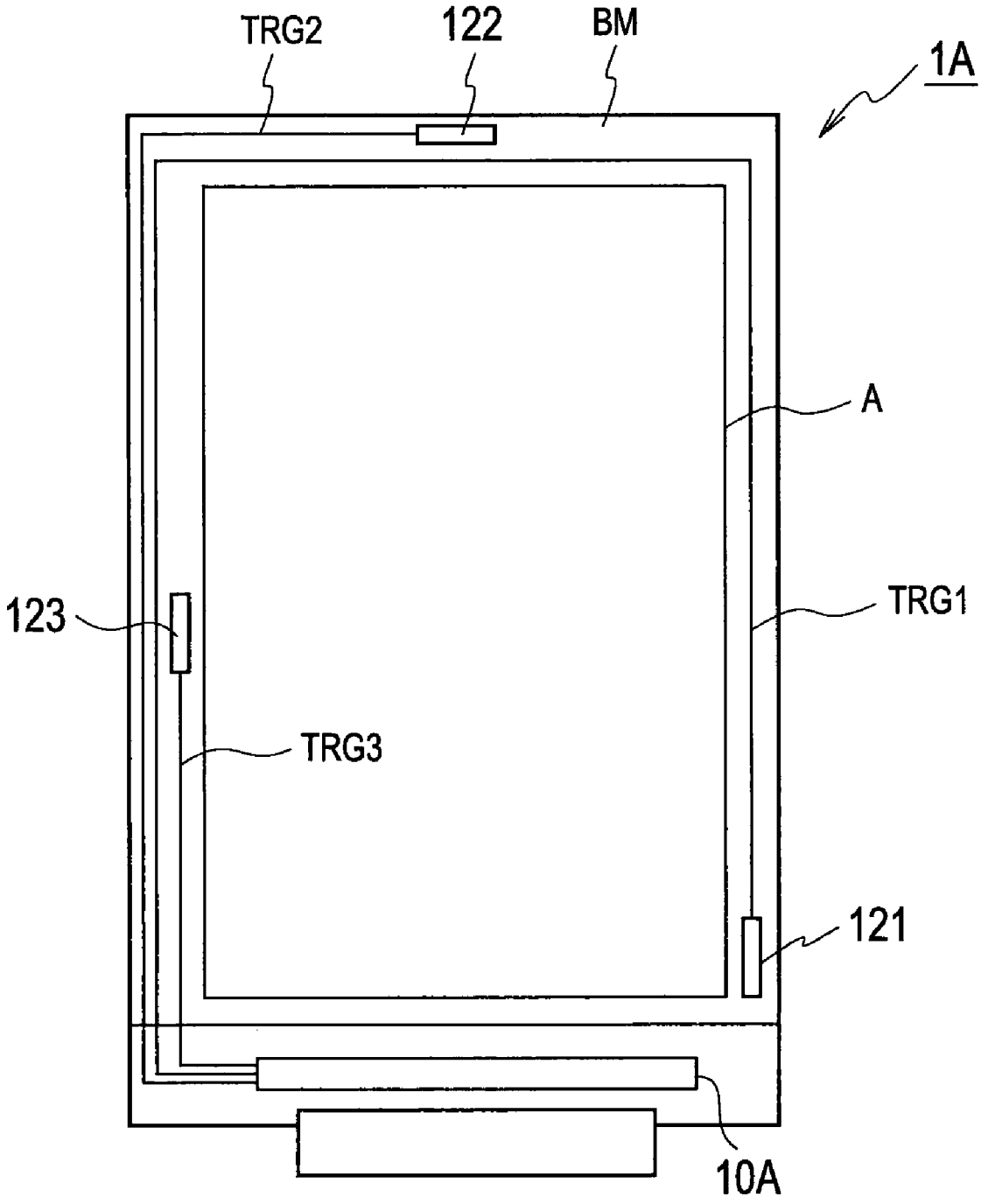
FIG. 7 illustrates a plan view of a liquid crystal display device according to a second embodiment of the present invention.

As illustrated in FIG. 7, the liquid crystal display device 1A according to the second embodiment of the present invention is similar to the liquid crystal display device 1 according to the first embodiment. In the second embodiment, the same reference marks are assigned to the same elements. And the same explanation will be omitted. Hereinafter, the difference will mainly be described.

In the liquid crystal display device 1A, a black matrix BM is formed in an area shaped like a picture frame surrounding a display unit A. An outside Large Scale Integration device 10A is mounted outside the area the black matrix BM is formed.

Light sensor circuits 121, 122 and 123 are arranged in the area where the black matrix BM is formed. The each light sensor circuit 121, 122 and 123 has the light sensor circuit and the arithmetic circuit. The light sensor circuits 121, 122 and 123 output trigger signals TRG1, TRG2 and TRG3 each being similar to the trigger signal TRG respectively. The each trigger signal is provided to the outside Large Scale Integration device 10A. One of the light sensor circuits 121, 122 and 123 receives a light from the backlight 9 for example, and the remaining light sensor circuits receive light from surroundings of the display area A.

Figure 8:
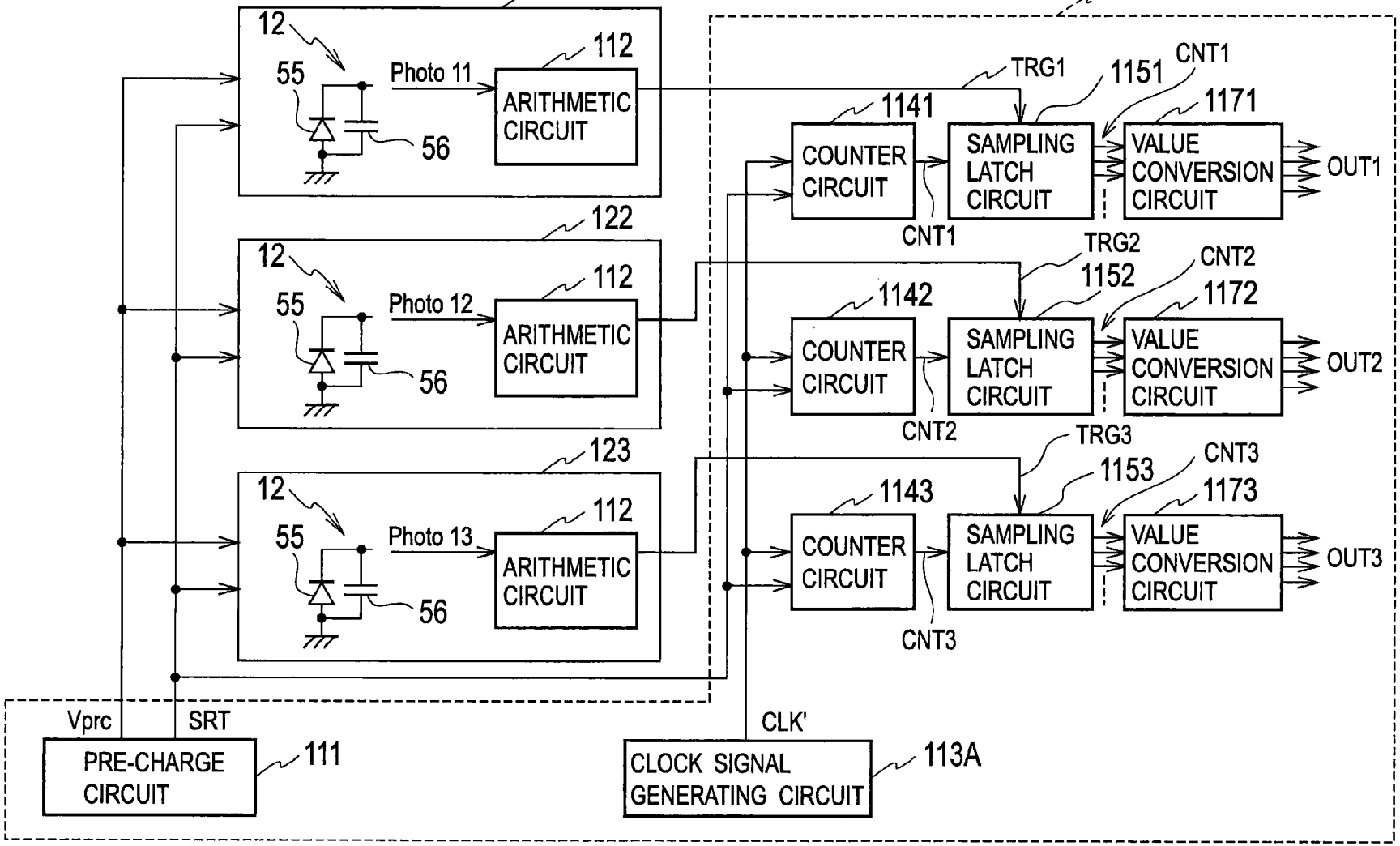
FIG. 8 illustrates a block diagram of a part of an outside Large Scale Integration device included in the liquid crystal display device in FIG. 7 and the light sensor circuits.

As illustrated in FIG. 8, the outside Large Scale Integration device 10A has the pre-charge circuit 111, a clock signal generating circuit 113A, counter circuits 1141, 1142 and 1143, sampling latch circuits 1151, 1152 and 1153, value conversion circuits 1171, 1172 and 1173. The each light sensor circuit 121, 122 and 123 has the light sensor circuit 12 and the arithmetic circuit 112.

The pre-charge circuit 111 firstly provides the constant voltage Vprc to the each light sensor circuit 121, 122 and 123. At a preset time during the voltage Vprc is provided, the pre-charge circuit 111 provides a start signal SRT to the light sensor circuits 121, 122 and 123, the counter circuits 1141, 1142 and 1143.

The each light sensor circuit charges the capacitor 56 by the voltage Vprc beforehand. A voltage between the electrodes of the each capacitor equals the voltage Vprc.

The each light sensor circuit disconnects the wiring the voltage Vprc is applied and the capacitor 56 when the start signal SRT is provided. A light current having an amount according to a surrounding illuminance of the display unit A or an illuminance of the light from the backlight 9 flows in the each photodiode 55. Because of this, the each capacitor 56 is discharged and the voltage between the electrodes decreases. The light sensor circuits 121, 122 and 123 output the voltages of the positive electrodes of the capacitors as electric signals Photo 11, Photo 12 and Photo 13 respectively.

The each arithmetic circuit 112 generates a data having a preset amount and gradually decreases the data similarly to the level of the electric signal from the light sensor circuit 12 that is decreased by the discharge of the capacitor.

The each arithmetic circuit 112 memorizes a threshold value beforehand and the arithmetic circuits provide the trigger signal TRG1, TRG2 and TRG3, one pulse signal for example, to the sampling latch circuits 1151, 1152 and 1153 respectively when the corresponding data becomes equal or less than the threshold value.

The clock signal generating circuit 113A provides the clock signal CLK' illustrated in FIG. 5, that is the clock signal CLK' whose level changes periodically, to the counter circuits 1141, 1142 and 1143.

The counter circuits 1141, 1142 and 1143 here increment count values CNT1, CNT2 and CNT3 respectively. The each counter circuit resets the corresponding count value when the start signal SRT is provided. Here, it is assumed that the each count value is a 16 bits value. The count value is reset to 0 that is the minimum of a range a 16 bits value can represent. Then the count value is incremented by one until becoming 65535 that is the maximum of the range.

The each counter circuit increments the corresponding count value at each change of the level of the clock signal CLK'. The each counter circuit provides the count value to the corresponding sampling latch circuit whenever the count value is incremented. The counter circuit does this also when the count value is reset.

The each sampling latch circuit samples the corresponding count value when the corresponding trigger signal is outputted. The sampling latch circuits provide the sampled count values CNT1, CNT2 and CNT3, by parallel signals, to the value conversion circuits 1171, 1172 and 1173 respectively.

The value conversion circuits 1171, 1172 and 1173 convert the count values CNT1, CNT2 and CNT3 to output values OUT1, OUT2 and OUT3 respectively and output the output values.

As illustrated in FIG. 9, the each value conversion circuit has a map table that has ranges for the corresponding count value each associated with an output value.

If any of the sampled count values is provided to the corresponding value conversion circuit, the value conversion circuit firstly finds one of the ranges in the corresponding map table that includes the sampled count value. Then the value conversion circuit outputs, by parallel signals, the output value associated with the range found as an output value OUT1, OUT2 or OUT3.

The larger the output value of the map table is, the smaller the count value included in the associated range is. And, the larger the output value of the map table is, the narrower the associated range is.

The output value is a 4 bits value as well as the output value illustrated in FIG. 6. The output value is included in a range from 0 to 15, and corresponds to the illuminance.

For example, the lower the illuminance is, the more gradual the decrease of the level of the electric signals Photo 11, Photo 12 and Photo 13 illustrated in FIG. 8 is. Therefore, the lower the illuminance is, the later the trigger signals are provided. And the count values are incremented. Therefore, the lower the illuminance is, the larger the sampled count values are.

Since the larger the output value of the map table is, the smaller the count value included in the associated range is, the lower the illuminance is, the lower the output values are. That is, the output values correspond to the illuminance.

As well as the count value CNT illustrated in FIG. 6, the each output value can represent a dynamic range of an illuminance that is about 1000 times.

Here, a comparative example having ranges of the same width in a similar map table will be described.

For example, it is assumed that the width is 100 so as to obtain an excellent linearity between the illuminance that is represented by logarithm and the output value in case that the output value is equal to or more than 10 and is equal to less than 15.

The maximum count value in the comparative example is 1600 (=16 times of 100) while the maximum count value in the second embodiment is 65535. Therefore, the comparative example can not represent the low illuminance corresponding to a count value larger than 1600.

Therefore, the output value in the comparative example might be able to represent a dynamic range that is only about 10 times for example.

On the contrary, as well as the count value in the first embodiment, the output value in the second embodiment is able to represent a dynamic range of an illuminance that is about 1000 times for example.

Additionally, since the larger the output value of the map table is, the narrower the associated range is, linearity between the illuminance and the output value can be excellent in a wide range of the illuminance.

Therefore, according to the second embodiment, since the larger the output value of the map table is, the narrower the associated range is, a dynamic range of the output value becomes wide. That is, a wide dynamic range of an illuminance can be measured. As a result, an illuminance can be measured both in the dark room and in outdoor of fine weather.

Note that the present invention is not limited to the first or second embodiments. The each liquid crystal display device may be changed as long as having the present invention's feature.

For example, although the clock signal CLK' having a constant cycle of changing levels is used in the liquid crystal display device according to the second embodiment, the clock signal CLK whose cycle of changing levels gradually becomes long may be used as well as in the first embodiment.

The map tables may be set individually so that difference between the output values that is caused by difference of characteristic of the light-into-electricity conversion elements in the light sensor circuits can be in a tolerance.

In case that the liquid crystal display device according to the second embodiment is mass-produced, the map tables may be different in each device so that the performance difference concerning the illuminance expression between the liquid crystal display devices can be in a tolerance.

The liquid crystal display device in the first or second embodiment is only an example of the display device according to the present invention. The display device may be one using organic electro-luminescence. In this case, it only has to adopt a similar composition to one used in the each embodiment for the illuminance measurement.

Though, in the first or second embodiment, the photodiode 55 is used as a light-into-electricity conversion element that discharges the capacitor charged in the light sensor circuit according to a light surrounding the display unit, the light-into-electricity conversion element may be a phototransistor.

What is claimed is:

1. A display device comprising:

a display unit having pixels;

a light sensor circuit having a capacitor and a light-into-electricity conversion element that discharges the capacitor according to a surrounding illuminance of the display unit;

an arithmetic circuit that decreases a data similarly to a voltage between electrodes of the capacitor and outputs a trigger signal if the data becomes equal to or less than a threshold value;

a clock signal generating circuit that generates a clock signal whose cycle of changing levels gradually becomes long;

a counter circuit that updates a count value at each change of the clock signal's level; and a sampling latch circuit that samples the count value when the trigger signal is outputted.

2. A display device comprising:

a display unit having pixels;

a light sensor circuit having a capacitor and a light-into-electricity conversion element that discharges the capacitor according to a surrounding illuminance of the display unit;

an arithmetic circuit that decreases a data similarly to a voltage between electrodes of the capacitor and outputs a trigger signal if the data becomes equal to or less than a threshold value;

a clock signal generating circuit that generates a clock signal whose level changes periodically;

a counter circuit that updates a count value at each change of the clock signal's level;

a sampling latch circuit that samples the count value when the trigger signal is outputted; and a value conversion circuit having a map table which has ranges for the sampled count value each associated with an output value, the value conversion circuit being configured to find one of the ranges which includes the sampled count value and outputs the output value associated with the range found;

wherein a larger output value of the map table corresponds to a narrower range associated with the output value.

3. The display device according to claim 1 or claim 2, wherein the light sensor circuit is formed in an area shaped like a picture frame of an array substrate in which the display unit is formed, the picture frame area surrounding the display unit.

* * * * *